US010766061B2

(12) United States Patent
Chazal et al.

(10) Patent No.: US 10,766,061 B2
(45) Date of Patent: Sep. 8, 2020

(54) DEVICE AND METHOD FOR PLANISHING METAL PRODUCT

(71) Applicant: Primetals Technologies France SAS, Savigneux (FR)

(72) Inventors: Jean-Pierre Chazal, Trelins (FR); Sébastien Maillard, Vernaison (FR)

(73) Assignee: PRIMETALS TECHNOLOGIES FRANCE SAS (FR)

( * ) Notice: Subject to any disclaimer, the term of this patent is extended or adjusted under 35 U.S.C. 154(b) by 231 days.

(21) Appl. No.: 15/716,950

(22) Filed: Sep. 27, 2017

(65) Prior Publication Data

US 2018/0085806 A1 Mar. 29, 2018

(30) Foreign Application Priority Data

Sep. 28, 2016 (EP) ..... 16290188

(51) Int. Cl.

| | |
|---|---|
| ***B21D 1/02*** | (2006.01) |
| ***B21D 37/14*** | (2006.01) |
| ***B21B 31/10*** | (2006.01) |

(52) U.S. Cl.

CPC ..... *B21D 1/02* (2013.01); *B21B 31/10* (2013.01); *B21D 37/14* (2013.01); *B21D 37/147* (2013.01)

(58) Field of Classification Search

CPC ..... B21D 1/02; B21D 37/04; B21D 37/14; B21D 37/147; B21B 31/08; B21B 31/10; B21B 31/103; B21B 31/0103

(Continued)

(56) References Cited

U.S. PATENT DOCUMENTS 3,111,100 A * 11/1963 Georgeff ..... B21D 37/04 100/224
4,881,392 A * 11/1989 Thompson ..... B21D 1/02 72/10.5

(Continued)

FOREIGN PATENT DOCUMENTS

CN 1168820 A 12/1997
CN 1295505 A 5/2001

(Continued)

OTHER PUBLICATIONS https://www.merriam-webster.com/dictionary/motor (Year: 2019).*

(Continued)

*Primary Examiner* — Edward T Tolan
(74) *Attorney, Agent, or Firm* — Ostrolenk Faber LLP

(57) ABSTRACT

An installation for planishing running metal of strip or plate products includes: a frame in which are disposed a lower planishing cassette and an upper planishing cassette, a lower drive device for driving planishing rollers of the lower cassette in rotation, an upper drive device for driving planishing rollers of the upper cassette in rotation. A displacement device displaces a secured assembly including the lower cassette and lower drive. The displacement device is activated for removal of the lower cassette from the frame toward one side or for insertion of the lower cassette from the one side into the frame. The secured assembly includes a replacement tool coupled to the lower cassette on a second operator side opposite the first motor side in relation to the product running axis. A method associated with the planishing installation is also described.

17 Claims, 3 Drawing Sheets

(58) Field of Classification Search
USPC ..... 72/160
See application file for complete search history.

(56) References Cited

U.S. PATENT DOCUMENTS

| | | | | |
|---|---|---|---|---|
| 5,129,254 | A * | 7/1992 | Keizer | B21D 37/14 100/229 R |
| 5,746,081 | A * | 5/1998 | Klamma | B21B 1/36 72/229 |
| 5,901,597 | A | 5/1999 | Muller | 72/229 |
| 6,282,938 | B1 | 9/2001 | Mertens | 72/202 |
| 6,568,234 | B2 | 5/2003 | Shore | 72/228 |
| 2011/0107888 | A1* | 5/2011 | Thielges | B21D 28/005 83/139 |
| 2019/0001384 | A1* | 1/2019 | Werner | B21D 1/02 |
| 2019/0176200 | A1* | 6/2019 | Kapp | B21D 35/002 |

FOREIGN PATENT DOCUMENTS

| | | | | |
|---|---|---|---|---|
| CN | 1367049 | A | 9/2002 | |
| CN | 104138903 | A | 11/2014 | |
| DE | 3221430 | A1 * | 12/1983 | B21B 31/10 |
| EP | 2117741 | A2 * | 11/2009 | B21D 1/02 |
| GB | 2 445 680 | A | 7/2008 | |
| JP | 59-30409 | A * | 2/1984 | B21B 31/10 |
| JP | 64-83317 | A * | 3/1989 | B21D 1/05 |
| WO | WO 2008/145355 | A1 | 12/2008 | |
| WO | WO 2010/097100 | A1 | 9/2010 | |

OTHER PUBLICATIONS

European Search Report dated Apr. 4, 2017 in corresponding European Patent Application No. 16290188.8.
Chinese Office Action, dated Mar. 5, 2020, issued in corresponding Chinese Patent Application No. 201710897584.0. English Translation. Total 23 pages.

* cited by examiner

DEVICE AND METHOD FOR PLANISHING METAL PRODUCT

CROSS-REFERENCE TO RELATED APPLICATION

The present application claims priority of European Patent Application No. EP 16290188.8, filed Sep. 28, 2016, the contents of which are incorporated by reference herein.

TECHNICAL FIELD

The present invention relates to a device and a method for planishing metal product of strip or plate type. Planishing sheet metal is defined as flattening, smoothing, and/or toughening the metal product by hammering or between rollers.

TECHNICAL BACKGROUND

Currently, installations for planishing running metal product of strip or plate type are known and generally comprise:

- a frame in which are disposed a lower planishing cassette and an upper planishing cassette,
- a lower drive means for driving planishing rollers of the lower cassette in rotation,
- an upper drive means for driving planishing rollers of the upper cassette in rotation,
- the upper and lower drive means are disposed on a first so-called "motor" side, located external to the frame, laterally in relation to a product running axis.

Particularly on both cold and hot rolling installations including a planishing or a pre-planishing, for example of "steckel mill" type (hot reversible rolling mill) or "plate mill" type (strong steel plate rolling mill), even a rough turning section of an installation of "hot strip mill" type (hot strip rolling mill), it is desirable for plate or strip products whose criteria of thickness, of flatness, of strain hardening or other mechanical properties are highly variable to be more or less planished, or even not at all.

If a planishing is not required, a first method would consist in removing the upper cassette to allow the product to pass without planishing and to use the lower cassette as a simple roller table to support the product in its passage. Consequently, the planishing rollers of the lower cassette are inappropriate for the simple function of supporting product by rolling and are very costly. It is therefore essential to prevent them from undergoing damage detrimental to their otherwise providing good planishing quality. Furthermore, the simple rolling speed of the product on the lower cassette would generally be much higher than the speed of planishing of a product (for example five times higher). This difference in speeds would also generate overheating effects or jerks and would therefore produce marks from the product on the planishing rollers, and therefore would cause an obvious degradation of the surface condition of the rollers, and therefore is detrimental to the planished product quality, which would require premature and therefore costly changes of the rollers.

One object of the present invention is to propose a metal product planishing installation that makes it possible to temporarily inhibit, and for example replace by at least one rolling-based product support structure, a functionality or a step of planishing for at least one product of a sequence of running products, without damaging the planishing installation.

This inhibition might be done for example during replacement by at least one rolling-based product support structure.

It might be done reversibly to re-establish a planishing functionality or step for another subsequent product. Switching from a planishing functionality to a planishing inhibited functionality (for example rolling support functionality), or vice versa for the same product during a series of passes of this same product in the installation is also envisaged.

It is thus also necessary to perform such a planishing inhibition (and replacement of functionality for example by at least one rolling-based product support) within a fairly short time period so as not to slow the flow of arrival of the products on the planishing installation, that is without reducing the productivity of the overall installation of a line using the planishing installation. This period is estimated at the maximum to be a time interval lying between the time of departure of the tail of a first product on leaving the planishing installation (in active planishing mode) and the time of arrival of the head of a second subsequent product on entering the installation (in planishing inhibited mode).

Another object is, finally, instead of the planishing step, to be able to introduce at least one completely different functional step associated with the metallurgical method of the line, different from the step of a simple rolling-based product support given here by way of example.

To this end, a planishing installation and a method implemented by said installation are thus proposed herein.

An exemplary embodiment and application illustrating the planishing installation and the associated method according to the invention is provided using Figures described:

DESCRIPTION OF AN EMBODIMENT

Figure 1:
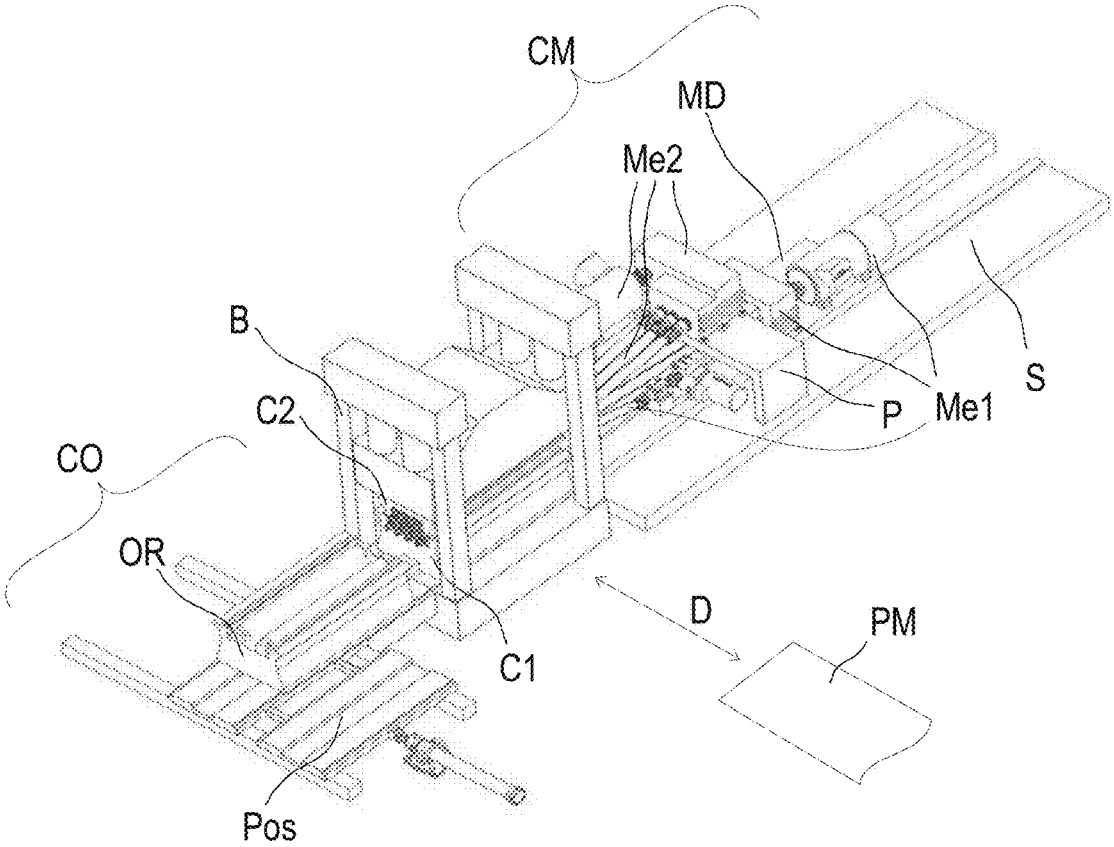
FIG. 1 is a first overview of the planishing installation according to the invention, on the upstream side, in its active planishing mode.

FIG. 1 presents a first overview of the planishing installation according to the invention, on the upstream side in relation to the direction or running axis D of a metal product (PM) in active planishing mode. The running can moreover be reversible, which is indicated by the double-headed arrow, referenced by the axis (D). Moreover, the same planishing installation can be considered with an upstream running side being situated on the side opposite in relation to the representation of FIG. 1.

The installation for planishing running metal product (PM) of strip or plate type comprises:

a frame (B) in which are disposed a lower planishing cassette (C1) and an upper planishing cassette (C2), a lower drive means (Me1) for driving planishing rollers of the lower cassette in rotation, an upper drive means (Me2) for driving planishing rollers of the upper cassette in rotation, the upper and lower drive means are disposed on a first motor side and are external to the frame, laterally in relation to a product running axis, a displacement means (MD) for displacing a secured assembly comprising the lower cassette and the lower drive means, the displacement means being able to be activated for removal (here by translation) of the lower cassette from the frame toward the first motor side (CM) or, conversely, for an insertion of the lower cassette from the first motor side into the frame, the secured assembly comprising a replacement tool (OR) for the lower cassette, said tool being coupled to the lower cassette on a operator side (CO) opposite the first motor side in relation to the product running axis (D).

Thus, the step of changing from an active mode of the planishing installation to switch the planishing installation to a planishing inhibited mode is performed in order to also allow a mode of operation linked to the replacement tool (here, a roller table OR used to support the product by rolling). The secured assembly in active planishing mode is advantageously kept in the secured form until the planishing inhibited mode (and vice versa), that is that it is free of any decoupling of the drive means and of their respective cassettes, and of any decoupling of any other means necessary to the operation of the planishing installation and its components, such as connections for signals and/or power supply and fluids or gases distributed for the components. In other words, the lower and upper drive means (motorizations, reducing gears, extension pieces, connectors, etc.) and the planishing rollers of the lower and upper cassettes remain coupled together, and the other connection means (connections for signals and/or supply) necessary to the operation of the planishing installation also remain securely connected upon transition from an active mode to an inhibited mode, and vice versa. This allows for a considerable time saving compared to a solution requiring a decoupling or any other separation of cassettes from its drive means and of the connections in order to replace at least the lower cassette by the replacement tool.

The replacement tool can advantageously comprise a wide range of tools (alone or combined) such as: a roller table or a measurement means or an inspection means or a cutting means, or a maintenance means, or a cleaning means, or a pickling means, or a surface treatment means.

In the example given to illustrate an embodiment of the installation according to the invention, a horizontal roller table for conveying product along the running axis is represented as replacement tool (OR) in standby position on the operator side. The roller table is advantageously equipped with intrinsic means for driving its rollers in rotation, which makes it possible to be able to increase the speed of passage of a subsequent product (not planished, in planishing inhibited mode) at will, and therefore safeguard against any damage to the planishing rollers of the lower cassette if the product had to pass on top.

The displacement means (MD) can simply comprise a carriage (like a rolling or sliding structure) coupled both to the lower drive means and to the lower cassette. The carriage coupling makes it possible to advantageously keep all of the lower drive means secured to the lower cassette upon the transition from the active planishing mode to the planishing inhibited mode and vice versa.

The replacement tool (OR) (such as the roller table represented) is conveyed and disposed on the operator side (CO) facing the frame B (B) by means of a known multiple-position lateral positioning system (Pos) such as that which sometimes already advantageously exists to perform a removal of the cassettes for a rapid swap with another operational set of cassettes. The replacement tool is then simply moored to the lower cassette in order to be able to follow the same movements (transverse to the running axis D) as said cassette upon the activation of said forward/reverse movements governed by the displacement means (MD).

Figure 2:
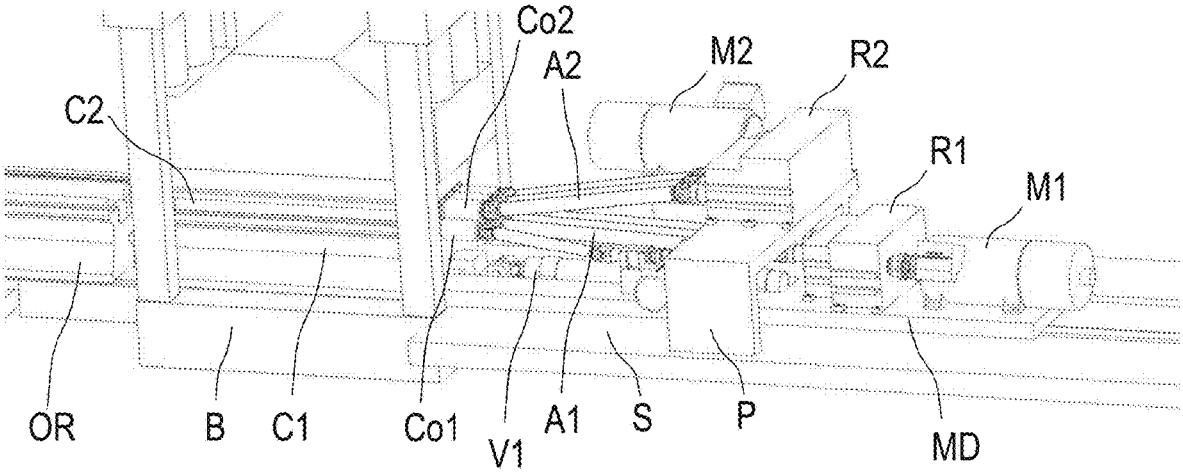
FIG. 2 is a second view of the planishing installation according to the invention, on the upstream side, in its active planishing mode.

FIG. 2 presents a second view of the planishing installation according to the invention (like FIG. 1), from the upstream side, in active planishing mode.

The lower and upper drive means (Me1, Me2) previously described in FIG. 1 comprise at least respectively a motorization (M1, M2), optional reducing gear modules (R1, R2) and extension pieces (A1, A2) coupled to the planishing rollers of the respectively lower and upper cassettes by means of connectors (Co1, Co2). These connectors generally form an integral part of the extension pieces, such as sleeves, but are here specified to describe the invention more clearly.

An extraction means (V1) for extracting the two lower and upper cassettes toward the operator side (CO) is embedded on the displacement means (MD), such that the two cassettes can be extracted from the frame (B) for example for a conventional maintenance operation. This extraction means coupled to the lower cassette however remains simply in retracted position upon change from the active planishing mode to the planishing inhibited mode. The retracted position favors a protection of the internal rod of the cylinder against external pollution during both active planishing and planishing inhibited modes. Furthermore and as a consequence of the permanent retraction of the cylinder and in the course of this change of modes governed by a translation of the displacement means (MD) driving the lower cassette (C1) toward the motor side (CM), the planishing rollers of the lower cassette (C1) can very advantageously remain housed in the connectors (Co1) of the extension pieces (A1). The extension pieces remain secured to at least one optional reducing gear module (R1) linked to at least the motor (M1), thus avoiding a dismantling of these elements, then above all finally avoiding a lengthy reassembly for the return to active planishing mode. The optional reducing gear module (R1) represented is given by way of example, and could be eliminated or replaced by a form of pinion stand of reducing, multiplying or simple gear type. To sum up, upon a change from active planishing mode to a planishing inhibited mode, and vice versa, the carriage, as simple and rapid displacement means (MD), takes on board the secured assembly comprising the lower cassette (C1), the extension pieces (A1) and their connectors (Co1), the optional reducing gear module (R1) and the motor (M1). Since the extension pieces driving the planishing rollers are thus, here, never decoupled from the rollers, the time it takes to replace the lower cassette with the replacement tool is therefore primarily dependent only on the speed of the displacement means (MD). Depending on the dynamic performance levels of the displacement means (MD), it is therefore technologically possible to reduce the period of the changeover cycle according to the needs required, such as the distance and the speed between a tail of a product and a head of a subsequent product.

The upper drive means (Me2) of FIG. 1 is detailed in FIG. 2 and comprises connectors (Co2) to the rollers of the upper cassette (C2). The connectors are linked to the extension pieces (A2), themselves driven by at least one optional module (R2) linked to at least one motor (M2). The optional reducing gear module (R2) represented is given by way of example, and could be eliminated or replaced by a form of pinion stand of reducing, multiplying or simple gear type. The upper drive means (Me2) is sufficiently raised in relation to the lower drive means (Me1), for example by being disposed on or above a bridge (P) fixed to the ground (S), such that the lower drive means (Me1) passes under the bridge upon a change of the lower cassette (C1) with the replacement tool (OR), and vice versa. Here again, no dismantling or reassembly of the "upper" secured assembly linked to the upper cassette and to the upper drive means is required. Furthermore, this upper secured assembly advantageously requires no significant displacement and no dismantling. Even though the upper cassette (C2) has to be slightly raised vertically (for example, separated from the lower cassette by a few mm or cm) in the frame (B), this slight displacement operation requires no dismantling of the upper secured assembly and remains very short in time (a few seconds). It is also able, moreover, to be performed in a concurrent operation time relative to the main replacement of the lower cassette with the replacement tool.

Figure 3:
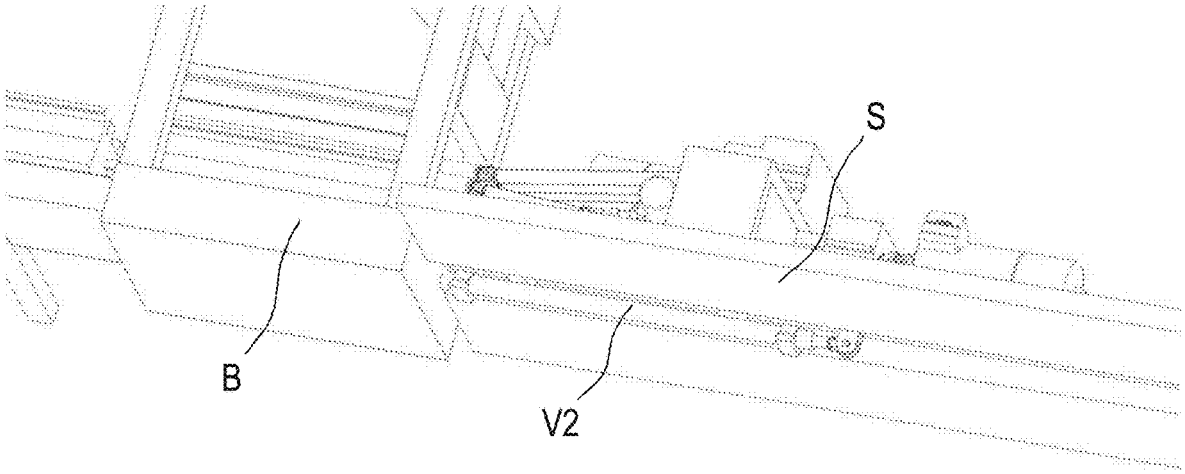
FIG. 3 is a third view of the planishing installation according to the invention, on the upstream side, seen from below, in its active planishing mode.

The carriage (an implementation of displacement means MD) can finally be moved in relation to the ground (S) or to the frame (B) fixed to the ground and/or to the other fixed elements by means of a single motor element such as a cylinder (V2). See FIG. 3 representing a third view of the planishing installation according to the invention (like FIGS. 1 and 2), from the upstream side, seen from below, in active planishing mode— or any other translational motorization means of pinion on rack type, etc. In the case of a cylinder, this motorization means coupled to the lower cassette however remains simply in retracted position during an active planishing mode. The retracted position favors a protection of the internal rod of the cylinder against external pollution during the planishing.

Figure 4:
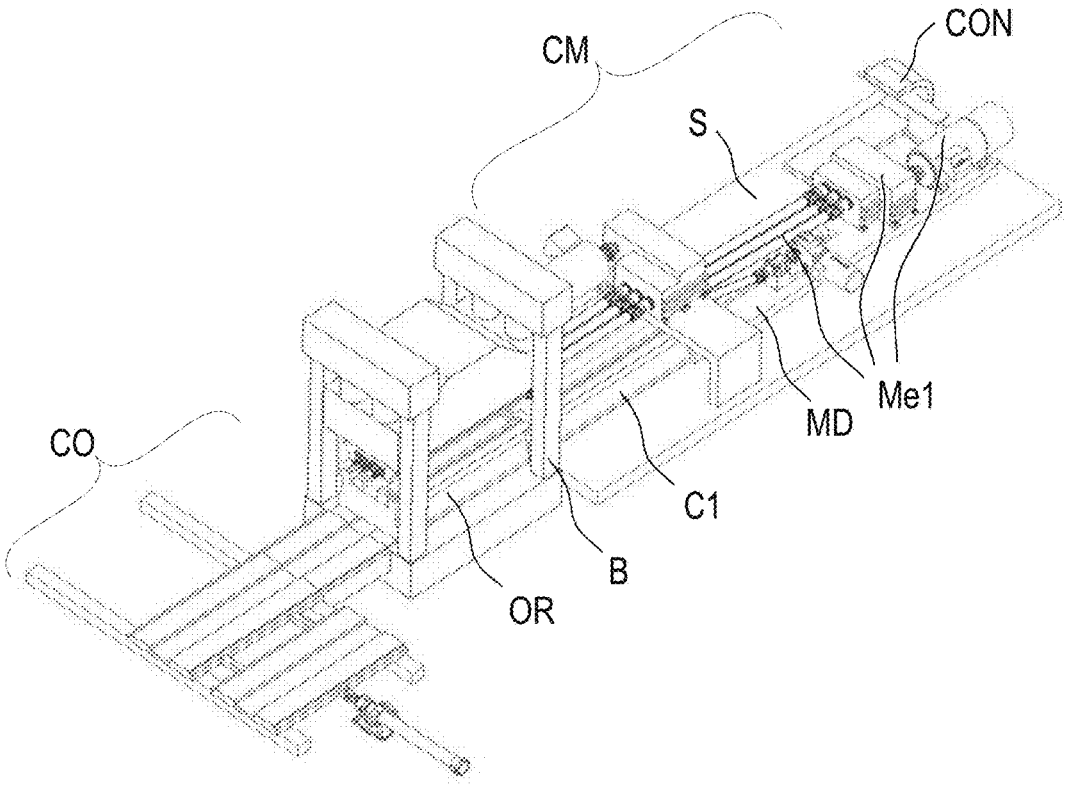
FIG. 4 is a fourth view of the planishing installation according to the invention, on the upstream side, in its planishing inhibited mode.

FIG. 4 presents a fourth view from the upstream side of the planishing installation according to the invention as in FIGS. 1 to 3, in planishing inhibited mode, that is once the lower cassette (C1) has been displaced toward the motor side (CM). The replacement tool (OR) such as the roller table represented in this example has then also been driven by the lower cassette in order to take its place.

The installation according to the invention also provides connections (CON) for signals and/or power supply and fluids or gases distributed for the lower drive means (Me1), the lower cassette (C1) and possibly the replacement tool (OR). These connections (CON) are simply coupled to the ground (S) or to the frame (B) fixed to the ground and/or to other fixed elements and to the displacement means (MD) providing appropriate connectors for said connections (CON). In the same way as the secured assembly comprising the lower cassette (C1) and the lower drive means (Me1), these connections (CON) therefore remain advantageously free of any disconnection or decoupling, upon a replacement of the lower cassette with the replacement tool, and vice versa. Here again, a considerable time saving is therefore achieved upon the replacement. Practically according to the example given here, the connections (CON) comprise flexible supports such as cable-holding chains disposed between the ground (S) and, at least if necessary, one of each of the various components of the secured assembly, namely:

the lower drive means (Me1) comprising a motor, a reducing gear module coupled to the motor and the lower extension pieces;

the lower cassette (C1);

optionally and preferentially, the replacement tool if it requires at least any supply whose implementation would be possible from the motor side of the frame toward said tool.

Figure 5:
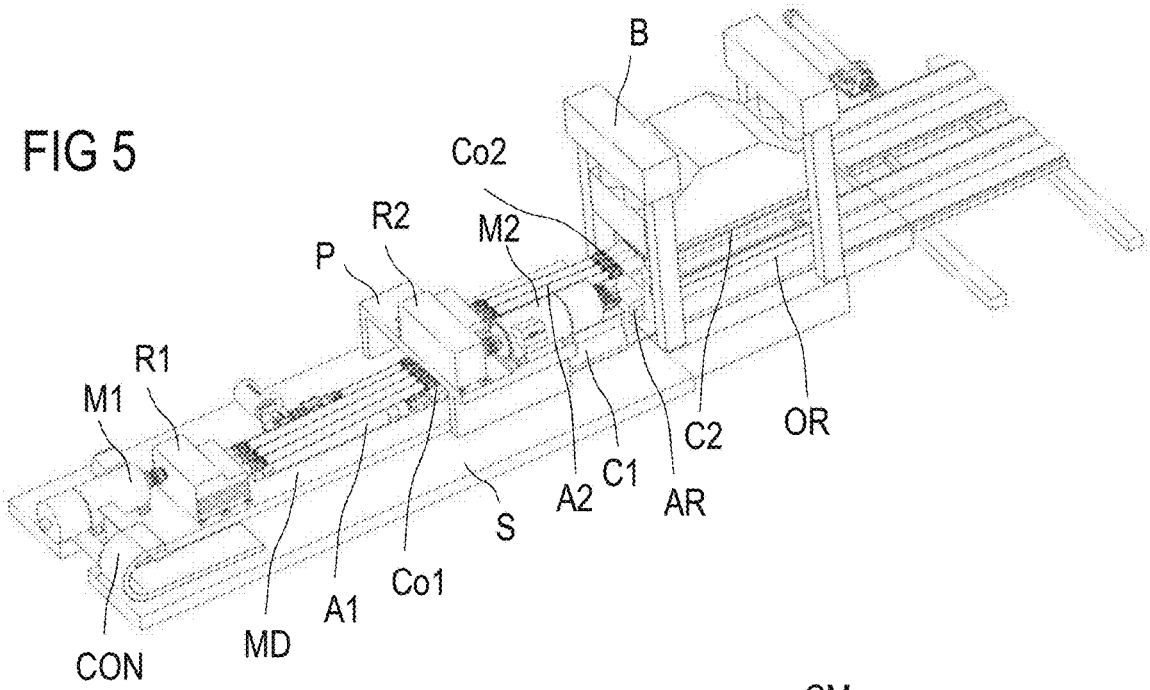
FIG. 5 is a fifth view of the planishing installation according to the invention, on the downstream side, in its planishing inhibited mode.

FIG. 5 finally presents a fifth view of the planishing installation according to the invention according to one of FIGS. 1 to 4, in planishing inhibited mode as in FIG. 4, but from a downstream side.

The lower and upper drive means (Me1, Me2) according to FIG. 1 and their supply means (CON) according to FIG. 4 are more explicitly represented or detailed therein.

In particular, the secured assembly comprises, in series, the motor (M1), the optional reducing gear module (R1), the extension pieces (A1) and their connectors (Co1), the lower cassette (C1) to which the replacement tool (OR) is moored (by coupling AR), are all coupled to the flexible connection means (CON) over a complete travel of the displacement means (MD) defined by its positioning between both active planishing and planishing inhibited modes.

As an alternative to the exemplary embodiments of the installation according to the invention presented in FIGS. 1 to 5, it is possible to provide the lower and upper drive means (Me1, Me2) for driving planishing rollers of the lower and upper cassettes in rotation to be powered by a single motor (instead of the at least two motors (M1, M2) represented in FIGS. 1 to 5).

Figure 6:
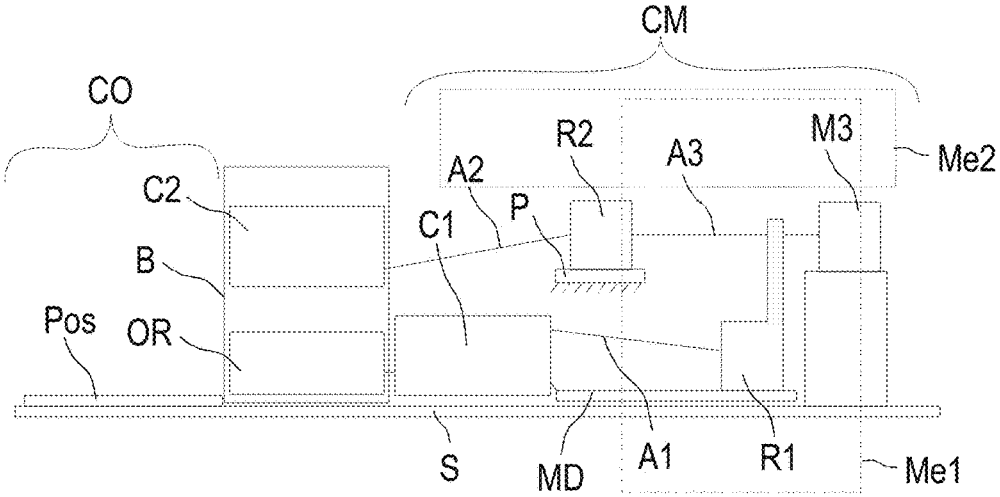
FIG. 6 is a sixth view from the upstream side of the planishing installation according to the invention, in its planishing inhibited mode, and comprising a single motor.

To this end, FIG. 6 presents a sixth view from the upstream side of the planishing installation according to the invention, in planishing inhibited mode. The installation comprises a single motor (M3) and an extension piece (A3) linking the motor (M3) to the optional reducing gear modules (R1, R2). Compared to the lower and upper drive means (Me1, Me2) of FIGS. 1 to 5, the representation of FIG. 6 details these means respectively referenced by M3, A3, R1, A1 and M3, A3, R2, A2.

In this case, provision is made for the displacement means (MD) for displacing a secured assembly (C1, Me1) comprising the lower cassette (C1) and the lower drive means (M3, A3, R1, A1). The displacement means is able to be activated for a removal of the lower cassette from the frame (B) toward the first motor side (CM), or vice versa, for an insertion of the lower cassette from the first motor side into the frame. The secured assembly comprises a replacement tool (OR) for the lower cassette, the tool being coupled to the lower cassette on a operator side (CO) opposite the first motor side in relation to the product running axis (D).

FIG. 6 thus presents a first secured assembly comprising the lower cassette (C1) and the lower drive means. The lower drive means comprises the single motor (M3), an extension piece (A3) linking the motor to an optional reducing gear module (R1). The optional module is coupled to the extension piece (A1) connected to the planishing roller of the lower cassette (C1). In the interests of clarity, the connectors (Co1, Co2) of the extension pieces of FIGS. 1 to 5 have not been represented.

The extension piece (A3) drives the two optional lower and upper reducing gear modules (R1, R2). The lower reducing gear module (R1) is however axially free on the extension piece (A3). The extension piece (A3) is fixed in relation to the ground (S). The upper reducing gear module (R2) is fixed in relation to the ground (S) (for example on a bridge P).

In FIG. 6, the motor (M3) is fixed in relation to the ground (S), and the displacement means (MD) drives the optional reducing gear module (R1), the extension piece (A1), the lower cassette (C1) and the replacement tool (OR). In the interests of clarity, the signal and/or supply connections (CON) of FIGS. 1 to 5 have not been represented, but are also coupled to the displacement means (MD) similarly to FIGS. 4 and 5.

Figure 7:
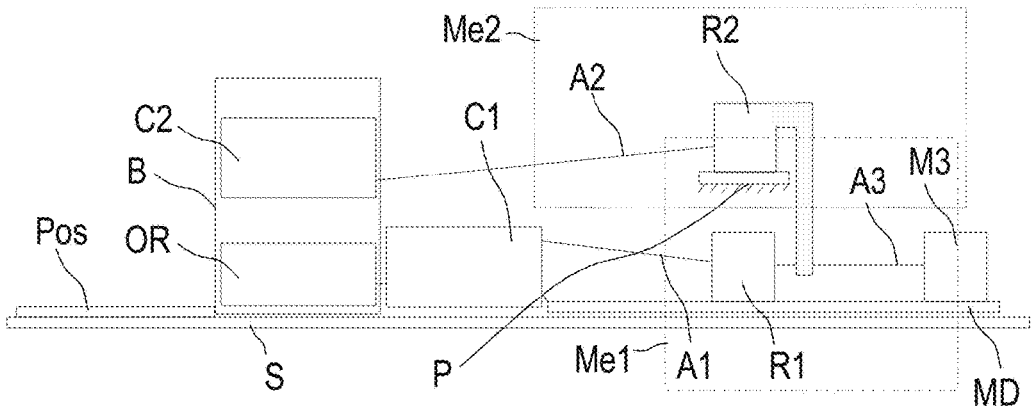
FIG. 7 is a seventh view from the upstream side of an alternative planishing installation according to FIG. 6, in its planishing inhibited mode, and comprising a single motor.

FIG. 7 presents a seventh view from the upstream side of an alternative planishing installation according to FIG. 6, in planishing inhibited mode, comprising the single motor (M3).

Here, unlike in FIG. 6, the motor (M3) and its extension piece (A3) are embedded on the displacement means (MD). The extension piece (A3) drives the two optional lower and upper reducing gear modules (R1, R2). The lower reducing gear module (R1) is however mobile with the extension piece (A3) in relation to the ground (S), these two elements being mobile on the displacement means (MD). The upper reducing gear module (R2) is fixed in relation to the ground (S) (for example on a bridge P), but the extension piece (A3) is free axially in relation to the reducing gear module (R2).

Complementing FIGS. 1 to 7 exemplary embodiments of the planishing installation according to the invention comprise either a single motor (M3) or two motors (M1, M2). It would be possible for there to be more than two motors to drive groups of planishing rollers, or to even drive the rollers individually.

Using the features of FIGS. 1 to 7, a method for planishing metal product (PM) of strip or plate type may be implemented by a planishing installation according to the invention as described herein, and comprising the following steps:

performing a first product pass in the installation;

performing a second product pass in the installation;

wherein at least one of the two passes is an active planishing pass and the other pass is a planishing inhibited pass which is preceded by activation of the displacement means (MD) for displacing the secured assembly and allowing replacement of the lower cassette (C1) by the replacement tool (OR) in order to generate a functional step other than a planishing step, and vice versa if necessary.

That method according to the invention enables the same product to undergo the first and second passes, if for example:

the planishing installation has to remain open and in a roller table mode, to support, without rolling speed problems, the product while the product is rolled by a rolling mill unit situated upstream or downstream of the planishing installation, and, by virtue of the extension of the rolled product or its displacement, can be extended over a greater distance than the rolling interval between the rolling mill unit and the planishing installation;

the planishing installation is used reversibly or not reversibly for the product passing through it, bearing in mind that a certain number of passes is free of planishing and at least one pass can require an active planishing.

Complementarily, the method according to the invention can also provide for a first product to undergo the first pass and a second distinct product to undergo the second pass.

For example, such a procedural scheme may comprise the following steps:

the first product undergoes a planishing step and leaves the planishing installation, the second product which is at a distance from the first product is conveyed to enter the planishing installation, since the second product requires a functional step other than planishing, activation of the displacement means (MD) for displacing the secured assembly is ordered, allowing replacement of the lower cassette (C1) with the replacement tool (OR) dedicated to ensuring a functional step other than the initial planishing step on entry of the second product into the installation.

The functional step of the method according to the invention can variably be at least one of the following steps: a product rolling-based support step or a measurement step or an inspection step or a cutting step, or a maintenance step, or a cleaning step, or a pickling step or a surface treatment step.

Preferentially, the complete replacement step is performed within a time period less than a time interval lying between the time of departure of product from the planishing installation and the time of arrival of product in the installation. This is thus the case for a single product undergoing the two abovementioned first and second passes.

For the first and second products mentioned above, the method according to the invention provides for the complete replacement step to be performed within a time period less than a time interval lying between the time of departure of the tail of the first product at the output of the planishing installation and the time of arrival of the head of the second product entering the installation.

It is thus possible to provide required time intervals as a function of the technological features of the system chosen for the displacement means (MD). The time interval is, for example, less than a few minutes, and ideally less than a minute. The time periods indicated previously can be of the same order in the case of the treatment of two different products or of the same product passing in succession into the installation in active planishing mode or planishing inhibited mode, and vice versa.

Finally, the method according to the invention provides the replacement step to be reversible in order to bring the lower cassette back into the frame, in place of the replacement tool. It is therefore possible to switch from an active planishing pass to a planishing inhibited pass (and with tool activated) and vice versa for any sequence of passes. The reversible successive steps are identically still fast in time, because they are free of any decoupling of the secured assembly and of connections attached thereto.

The method according to the invention can provide for a small vertical separation of the upper and lower cassettes to be established on starting activation at the start of the replacement of the lower cassette by the replacement tool.

Experience shows that this separation can be initiated in a very short time preceding the activation of the displacement means (MD), even in a sequence inscribed within a concurrent operation time relative to the activation of the displacement means (MD).

In addition to the translational displacement for example, by cylinder (V2) for example according to FIG. 3), the activation of the displacement means can moreover require an action of unlocking certain functions linked to planishing elements (for example, an unlocking of clamping or similar action). But, this type of action is of a duration of secondary importance. Depending on the dimensioning of the equipment, the weight of the elements to be displaced can, in addition, be so great for it to advantageously not require the use of clamping.

The invention claimed is:

1. An installation for planishing a metal strip or plate moving along a running path, the installation comprising:

a frame;

a lower planishing cassette comprising lower planishing rollers, and an upper planishing cassette comprising upper planishing rollers, the lower and upper cassettes disposed in the frame;

a lower drive located and configured for driving rotation of the planishing rollers of the lower cassette;

an upper drive located and configured for driving rotation of the planishing rollers of the upper cassette;

the upper and lower drives being disposed on a first motor side and external to the frame, laterally in relation to the running path;

a secured assembly comprising the lower cassette and the lower drive;

a displacement device positioned on the first motor side and configured and operable to be activated: (1) to remove the lower cassette from the frame toward the first motor side, or (2) to insert the lower cassette from the first motor side into the frame; and the secured assembly comprising a replacement tool for the lower cassette, the replacement tool being coupled to the lower cassette on a second operator side opposite the first motor side in relation to the running path.

2. The installation as claimed in claim 1, wherein the replacement tool comprises a roller table with at least one of the lower drive for driving the planishing rollers of the lower cassette in rotation, or a measurement device, or an inspection device, or a cutting device, or a maintenance device, or a cleaning device, or a pickling device, or a surface treatment device.

3. The installation as claimed in claim 1, wherein the displacement device comprises a carriage coupled to both the lower drive and the lower cassette, wherein the carriage is configured to move in relation to the ground or to the frame by at least one of a cylinder and a motorization device providing translation motion for the carriage.

4. The installation as claimed in claim 3, further comprising an extraction device for extracting the lower and upper cassettes toward the second operator side, the extraction device is embedded on the carriage.

5. The installation as claimed in claim 1, wherein the upper drive is raised in relation to the lower drive.

6. The installation as claimed in claim 1, wherein each of the lower and the upper drives comprises at least respectively a motorization and extension pieces coupled to the respective planishing rollers of the lower and upper cassettes.

7. The installation as claimed in claim 1, wherein the lower drive includes signals and/or power supply connections, and connections for fluids or gases distributed for the lower drive, wherein the lower cassette is coupled to the displacement device.

8. The installation as claimed in claim 1, further comprising a single motor for powering the lower and the upper drives for driving the planishing rollers of the lower and upper cassettes in rotation.

9. The installation as claimed in claim 5, wherein the upper drive is raised in relation to the lower drive by being disposed on or above a bridge fixed to the ground, such that the lower drive device passes under the bridge.

10. The installation as claimed in claim 1, wherein the lower drive includes signals and/or power supply connections, and connections for fluids or gases distributed for the lower drive, wherein the lower cassette and the replacement tool are coupled to the displacement device.

11. A method for planishing a metal strip or plate product moving along a running path, the planishing implemented by a planishing installation comprising:

a frame;

a lower planishing cassette comprising lower planishing rollers and an upper planishing cassette comprising upper planishing rollers, the lower and upper planishing rollers disposed in the frame;

a lower drive located and configured for driving rotation of the planishing rollers of the lower cassette;

an upper drive located and configured for driving rotation the planishing rollers of the upper cassette;

the upper and lower drives being disposed on a first motor side and external to the frame, laterally in relation to the running path;

a secured assembly comprising the lower cassette and the lower drive;

a displacement device configured positioned on the first motor side and operable to be activated: (1) to remove the lower cassette from the frame toward the first motor side; or (2) to insert the lower cassette from the first motor side into the frame;

the secured assembly comprising a replacement tool for the lower cassette, the replacement tool being coupled to the lower cassette on a second operator side opposite the first motor side in relation to the running path;

the method comprising:

performing a first product pass in the installation; and performing a second product pass in the installation;

wherein at least one of the first pass and the second product pass is an active planishing pass and the other pass of the first pass and the second pass is a planishing inhibited pass preceded by an activation of the displacement device for displacing the secured assembly including replacement of the lower cassette by the replacement tool in order to generate metal strip or plate processing different from the planishing pass.

12. The method as claimed in claim 11, wherein a same metal product undergoes the first and second passes.

13. The method as claimed in claim 11, wherein a first metal product undergoes the first pass and a second metal product undergoes the second pass.

14. The method as claimed in claim 11, wherein the other pass comprises a product rolling-based support step, or a measurement step, or an inspection step, or a cutting step, or a maintenance step, or a cleaning step, or a pickling step or a surface treatment step.

15. The method as claimed in claim 11, wherein the replacement is completed within a period less than a first time interval, the first time interval being a time between a time of departure of the metal product from the planishing installation and a time of arrival of a following second metal product in the installation.

16. The method as claimed in claim 15, wherein the first time interval is less than one minute.

17. The method as claimed in claim 11, wherein the replacement is reversible in order to bring the lower cassette back into the frame.

* * * * *